United States Patent [19]

Brotzmann et al.

[11] 3,945,820

[45] Mar. 23, 1976

[54] PROCESS AND IMMERSION LANCES FOR INTRODUCING OXYGEN INTO A METAL MELT

[75] Inventors: Karl Brotzmann; Hans Georg Fassbinder, both of Sulzbach-Rosenberg, Germany

[73] Assignee: Eisenwerk-Gesellschaft Maximilianshutte mbH, Sulzbach-Rosenberg, Germany

[22] Filed: Mar. 1, 1974

[21] Appl. No.: 447,422

[30] Foreign Application Priority Data

Mar. 3, 1973 Germany ..... 2310776

[52] U.S. Cl. ..... 75/60; 75/59

[51] Int. Cl.[2] ..... C21C 5/34

[58] Field of Search ..... 75/59, 60

[56] References Cited

UNITED STATES PATENTS

| | | | |
|---|---|---|---|
| 1,968,917 | 8/1934 | Soldatoff | 75/60 |
| 3,330,645 | 7/1967 | de Moustier | 75/60 |
| 3,706,549 | 12/1972 | Knuppel | 75/60 |
| 3,771,998 | 11/1973 | Knuppel | 75/60 |

*Primary Examiner*—Peter D. Rosenberg
*Attorney, Agent, or Firm*—Lawrence I. Field

[57] ABSTRACT

Immersion lances for refining metal melts in hearth type vessels including open hearth and electric furnaces. The lances are movable into and out of the metal melt and comprise an oxygen pipe, a cooling medium pipe surrounding the oxygen pipe and a refractory casing which is wear resistant, temperature resistant and chemically resistant to the operating surroundings. The process of refining using such lances is also described.

7 Claims, 5 Drawing Figures

PROCESS AND IMMERSION LANCES FOR INTRODUCING OXYGEN INTO A METAL MELT

The invention relates to a process and to immersion lances for refining metal melts by means of oxygen, preferably in hearth type vessels. The oxygen, which is surrounded by a protective medium, preferably gaseous and/or liquid hydrocarbons, in this process, is supplied to the metal melt by means of movable immersion lances sleeved in refractory material. The immersion lances dip through the bath surface and penetrate appreciably below it.

Oxygen has been used for many years for refining metal melts. Today the largest part of world steel production is by means of an oxygen top blowing process in which the oxygen is blown onto the metal bath in a refining converter by means of water cooled lances. Oxygen has also been used for about three decades in hearth processes such as the Siemens-Martin open hearth and in the electric furnaces for the purposes of increasing melt outputs. When oxygen is used in hearth type vessels, lances have been used, which consist essentially of a steel pipe provided with a thin ceramic layer in order to diminish scaling of the lance pipes. The wall thickness of such ceramic coatings usually does not exceed about 1 mm. When these lances are used to supply oxygen to Siemens-Martin or electrical furnaces, the pipes actually burn back very quickly the moment they are dipped into the metal bath. Therefore, the oxygen will be supplied essentially (only) to the slag or to the phase boundary between slag and metal. As is the case with oxygen top blowing, introducing the oxygen at the phase boundary results in appreciable oxidation of the slag. Hence, at least to a considerable extent, the oxygen is supplied to the metal melt via the slag. The high iron oxide content of the slag and failure to reach an equilibrium concentration between melt and slag, are drawbacks to this process.

Besides such relatively simple steel-pipe lances, expensive lance designs provided with cooling have been used for supplying oxygen to Siemens-Martin furnaces. Thus, a process is described in U.S. Pat. No. 3,115,405, wherein oxygen is introduced by means of a cooled lance. The patent further proposes using natural gas for cooling, recommending a volume ratio of oxygen to natural gas from 3/1 to 8/1. Again, the oxygen in this process is introduced essentially at the phase boundary of slag and metal. This results from the slight depth of immersion of the lance.

Besides these lance-processes in which oxygen is supplied preferably at the phase boundary of slag and metal, a process has recently become known, wherein oxygen is introduced through tuyeres mounted underneath the bath surface in the refractory lining of a refining vessel. The tuyeres consist of two concentric pipes, oxygen being supplied through the inner one and hydrocarbons through the annular gap between the pipes. The proportion of hydrocarbons with respect to oxygen ranges from 1 to 5% by weight. This process offers the advantage with respect to conventional processes of an appreciable shortening of the refining time, for instance in a Siemens-Martin furnace, and furthermore of reducing the iron oxide content and appreciably homogenizing the melt on account of a marked bath motion induced by the introduction of the oxygen. However, this stationary assembly of tuyeres mounted below the bath surface also entails drawbacks when used in an open hearth type vessel. For instance, when such a tuyere fails or burns back, a large part of the melt may leak out and cause considerable damage. This is rare, however, but larger damages must be expected in open hearth furnaces than with converters, because the former may not be tilted as quickly as the latter and therefore do not permit as rapid removal of the tuyeres from the bath region. A further drawback of tuyeres solidly built-in below the bath surface, for instance in Siemens-Martin furnaces, is the intended intermittent use of these tuyeres in supplying oxygen during only certain stages of the refining period. In practice, oxygen will be applied only during half or one third of the operating time. During the remaining time, the tuyeres must be cooled and kept clear in order to remain operational. Frequently it will be impossible to cool the tuyeres with comparatively cheap nitrogen, and in order to avoid nitrogen absorption by the metal bath, a more expensive inert gas, for instance argon, must be used. The danger of nitrogen absorption is especially important for melts that are tapped at high carbon contents, and in such instances, argon is used exclusively for cooling the tuyeres. The large amounts of gas required for cooling adversely affects the economics of this process.

The present invention is directed to avoiding the drawbacks of a stationary array of tuyeres and in maintaining the advantages relating to the metallurgy of refining reactions when introducing the oxygen underneath the bath surface. One object of the invention is to provide great flexibility to the conventional open hearth process, in a manner similar to the known introduction of oxygen through steel lances, without the drawbacks, expecially the high iron oxide content and the related increased wear of the refractory materials, and large gradients in concentration between slag and steel bath characteristic of such methods.

These and other objects are realized by the process of the invention for introducing oxygen preferably into hearth type vessels in that the oxygen, surrounded by a protective medium preferably consisting of liquid and/or gaseous hydrocarbons, is supplied to the metal melt by means of movable lance arrangements which are sheathed in refractory materials and which dip appreciably below the surface of the metal bath.

Specific embodiments of these immersion lances will be discussed in greater detail further below. These lances allow deep immersion of the lance in the metal melt and removal of the lance following refining. By use of these lances, periodic refining by means of oxygen is feasible and the lance may remain immersed in the metal bath during the entire refining period.

The immersion lances of this invention permit introducing the immersion lances from above, for instance through the arched roofs of Siemens-Martin furnaces, or as is presently preferred, the immersion lance may be introduced through the side, for instance through an appropriately shaped door, into the open hearth refining vessel. The interchangeable door design is especially useful in electric furnaces. The covers of such furnaces ordinarily being movable, the lance system otherwise would have to be moved along when passing through the roof, or else appreciable conversion of the conventional electric furnace roof would have been required if the immersion lances had to be introduced through the roof.

The actuating members for moving the immersion lances may be designed as purely mechanical means in the form of corresponding levers and gear arrangements, but preferably simple hydraulic members such as lift cylinders are used, these having been found very useful in practice. Obviously such equipment is mounted far enough from the hearth refining vessels so that it is not exposed to damaging temperatures, or else it is provided with adequate cooling or otherwise protected from high temperatures.

In the present invention, the immersion means is designed so that the discharge direction of the oxygen jet is essentially parallel to the metal bath surface, that is to say it is substantially horizontal. This may be achieved for instance in simple manner by a suitably bent immersion lance or an elbow may be connected to the discharge end. The immersed lance has a lower horizontal part, at its outlet end.

Another embodiment of the lance system of the invention provides for several discharge apertures in the lance system. Several, preferably two outlet tuyeres start from the common supply line in the vicinity of the outlet orifice, for instance at the lower, horizontal part of the immersion lance, said outlet tuyeres being branched on the oxygen supply line and each consisting of a central pipe for supplying the oxygen and a surrounding annular gap for supplying the hydrocarbons. The end pieces of the immersion lances subtend an angle to one another in a horizontal plane. If a lance comprises two outlet tuyeres, preferably that angle will be within the range of 30° to 90°.

The immersion lances in conformity with the present invention furthermore contemplates utilization of the oxygen as a cooling medium for the hydrocarbons, in order to counteract chemical dissociation of the hydrocarbons due to the influence of heat prior to discharge from the lance. Two methods were found suitable for cooling the relatively small amounts of hydrocarbons as compared to the larger quantities of oxygen. One embodiment of the invention relating to sheathing consists of sleeving with laminar, relatively thin discs of densely sintered or melt-cast refractory materials, for instance fused corundum. Such discs, which act as reinforcements, are slipped over the tuyere pipes directly or around insulating layers already wrapped around the pipe. The gaps and intermediate spaces between the individual refractory sheets, discs or sleeves are then filled by cast refractory material. In this manner one obtains close interlocking between the highly refractory cast material and the very dense, refractory casing material, and the latter will be extensively protected against thermal shock, the wear-resistance of the refractory material being considerably increased on account of said casing.

Deposits of solidified steel are formed at the tuyere tips when the immersion lances are used in actual operation, namely at the discharge orifices for oxygen and hydrocarbon. These deposits or scabs spread like mushrooms about the tuyere mouth and may grow to be several centimeters wide. While the central aperture remains open for discharge of oxygen, the protective medium will in most cases stream through these deposits in many other channels. The ordinarily uneven deposit formation may be used in conformity with the invention so as to increase durability provided that deposit formation be encouraged to spread over considerable areas. This can be achieved by covering the outlet gap of the protective medium with a porous material, for instance a panel of sintered metal. It was found that a deposit of 15 centimeters in diameter will occur within 15 minutes of immersing a lance so prepared, and that the deposit extensively protected the annular gap to its rear. Durability of the tuyere mouth could be increased considerably by such a measure. This construction furthermore offers easy repairs of the lance mouth by replacing the sintered metal plate, for instance.

In the first instance, the supply channel for the hydrocarbons is shifted into the oxygen pipe to the extent possible. Then the supply line passes into the inlet tuyere where the hydrocarbon surrounds the oxygen jets just before the outlet orifice.

In the second instance, the oxygen-carrying pipe is provided with cooling fins that may be of any suitable shape, and the flow of hydrocarbon preferably will pass between said fins. In such cases, the annular gap about the central oxygen inlet pipe is divided into a multitude of channels by means of the cooling fins (see FIG. 3).

The invention prevents or limits the temperature rise of the hydrocarbons because of the construction of the refractory sheathing of the immersion lances. It was found practical to deposit first a high-grade insulating layer approximately 1 to 2 centimeters thick, around the supply lines and inlet tuyeres, and then to mount the wear-resistant layer of the lance casing around said insulating layer. Suitable insulating materials for the first layer includes mats, loose materials and pre-finished shells or pipe-casing components based on refractory fiber materials.

Suitable refractory wear-resistant materials including composites based on corundum, magnesite, zirconium oxide and combinations of these as well as other, similarly highly refractory materials have been successfully used. Normally casings of wall-thicknesses from about 2 to 10 cm were found sufficient. In most cases these casings are cast into molds and are compacted by shaking. A specific wear-resistant casing will depend on the specific conditions. It is desirable to provide a highly wear-resistant casing for use under extreme loading. The casings of the immersion lances are required to meet the requirements of mechanical and chemical resistance and of high temperature resistance.

Practical experience furthermore has shown the usefulness of loading the oxygen with fine-grained slag-forming agents. For instance, lime may be easily introduced into the refining vessel in this manner. However, care must be taken in such instances that the inside surface of the oxygen inlet pipe be protected by means of a refractory coating so as to prevent erosion from the fine-grained solids. Thin enamel coats were found superior to other, thicker ceramic layers, the former being of higher thermal conductivity and favorably affecting the cooling of the hydrocarbons.

The invention will be further understood from the examples which follow taken in conjunction with the drawings in which.

Figure 5:
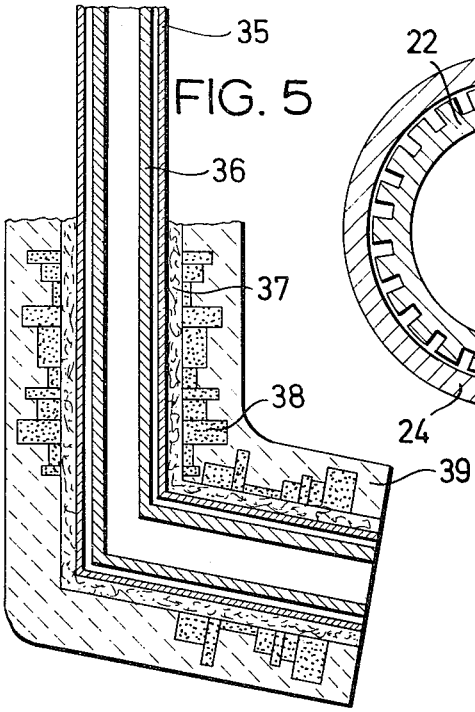
Figure 2:
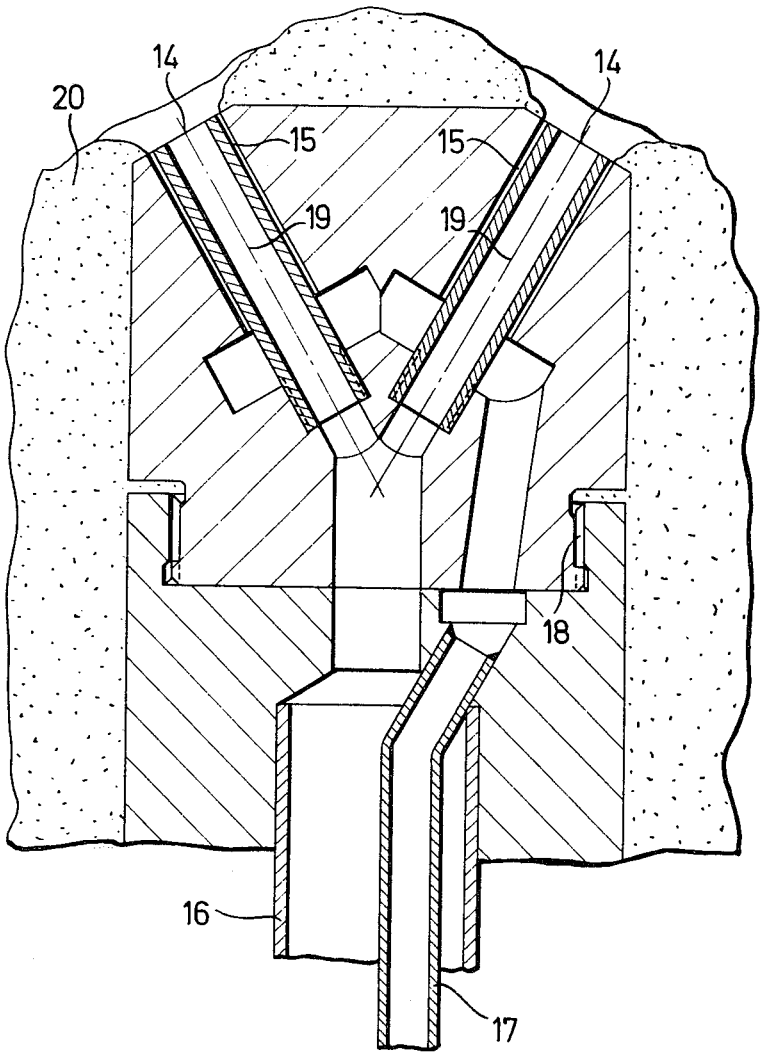
FIG. 2 is a fragmentary view showing the lower part of a lance with two tuyere outlet ends.
Figure 4:
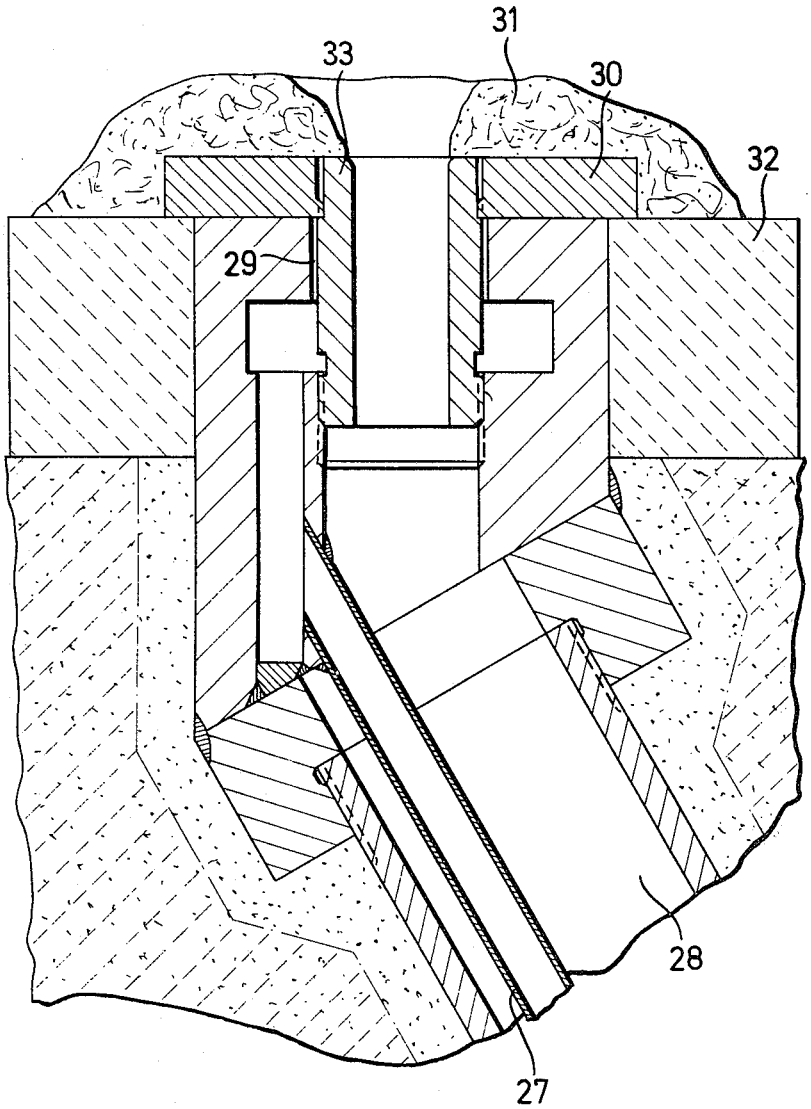

FIG. 4 is a view similar to FIG. 2 and shows the lower part of a modified immersion lance, wherein the protective medium pipe is relocated as far as the tuyere end in the oxygen pipe, and wherein a sintered metal sheet is mounted in front of the outlet annular gap for the protective medium; and FIG. 5 shows an example of the construction of the refractory casing of an immersion lance with casing sheets of an extremely dense, highly refractory material, for instance fused corundum.

Figure 1:
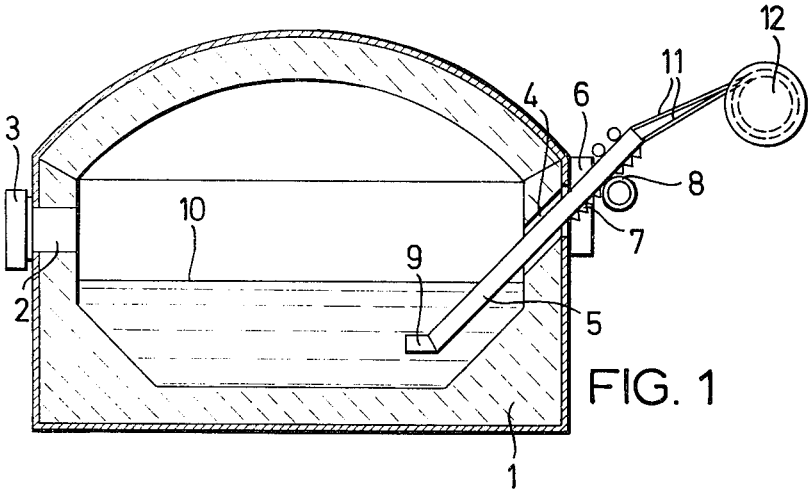
FIG. 1 shows the basic arrangement of the immersion lance in an open hearth vessel.

In a hearth refining vessel, shown as a Siemens-Martin furnace in FIG. 1, the immersion lance 5 is introduced preferably through the rear wall. The hearth refining vessel 1 is schematically shown in cross-section and is provided with charging apertures 2 in its front wall, these being covered by doors 3 in the usual way. An orifice 4 is located in the rear wall, which may be closed by a door 6 when the immersion lance 5 is removed. The lance will be moved in and out of the hearth refining vessel by means of gear rack 7 and drive 8. Tuyere end 9 of immersion lance 5 is bent in such manner that the oxygen will be discharged substantially parallel to bath surface 10.

Oxygen and protective medium supply to immersion lance 5 is achieved via hoses 11 unwinding from a drum 12.

FIG. 2 shows the tuyere tip of an immersion lance with two discharge orifices. Oxygen surrounded by the protective medium leaving this inlet tuyere from the annular gap 15 issues from the two oxygen discharge orifices 14 into the metal melt. Protective medium line 17 is shifted inside oxygen supply pipe 16, which terminates at the connection 18 for discharge tuyeres 19. The tuyere is surrounded by a refractory material 20. The immersion lance allows simple replacement of discharge tuyeres 19, by removing the refractory material as far as connection 18, by mounting new tuyere tips 19 to the connection 18 and by again encasing the tuyere tips 19 with refractory material 20.

Figure 3:
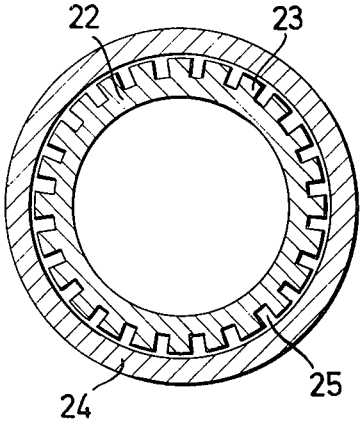
FIG. 3 is a view of a section taken through a lance and shows an example of a cooling fin arrangement for the oxygen lance pipe.

In FIG. 3, the cross-section of the tuyere pipes shows an embodiment of cooling fins suitable for the oxygen supply pipe which is provided with fins 23 over its entire periphery, said fins simultaneously acting as spacers for protective medium pipe 24. The annular gap between oxygen pipes 22 and protective medium pipe 24 therefore will be divided into individual channels 25.

FIG. 4 shows the lower end of an immersion lance with discharge tuyere and preplaced sintered metal sheet. The protective medium is supplied via line 27 inside oxygen supply line 28 to the annular gap 29. A sintered metal plate 30 is secured ahead of the annular gap. The protective medium therefore will distribute itself over thin channels, promoting the desired formation of a deposit of essentially solidified steel. The sintered metal disk at the same time holds a tuyere shaped brick 32, which may be easily replaced when replacing the entire discharge tuyere 33 together with the sintered metal disk 30.

FIG. 5 shows another embodiment of the refractory casing of a tuyere arrangement, which possesses an extremely high wear-resistance. Protective medium supply 35 is supported by the fins of oxygen inlet pipe 36 and coated with an insulating layer 37, made from pre-formed half-shells of a refractory fiber material. Variously shaped, extremely dense ceramic disks 38, made of fused corundum or of sintered zirconium oxide, are stacked around insulating layer 37. These disks serve both as reinforcements for refractory 39 and for increasing appreciably the wear-resistance of the overall refractory casing.

The invention will be further understood from the following illustrative example of the process of the invention:

First 7 tons of quicklime were loaded into a 200 ton Siemens-Martin furnace, and, thereafter, in the course of one hour, 75 tons of steel scrap was loaded into the furnace. During that time, the end burners of the furnace were in full operation at a rate of approximately 5,000 kg of oil an hour. The hot wind rate was approximately 60,000 standard m3/hour. The two oxygen immersion lances were removed from the furnace during that time and out of operation.

After scrap charging, a total of 150 tons of pig iron were charged from two ladles into the furnace. The pig iron analysis was as follows in weight %:

$C = 4.3\%$
$Mn = 0.8$
$Si = 0.7$
$P = 0.08$
$S = 0.05$
Balance iron.

Following charging of the pig iron, two oxygen lances were moved into the furnace. Approximately 500 standard cubic meters of $O_2$ and 60 standard cubic meters of propane used as protective medium were made to pass through each of the two lances during this immersion phase. When the immersion lances were in the refining position, that is, appreciably below the bath surface, the amount of oxygen was increased to 2,000 standard cubic meters per lance. Simultaneously, the rate of the end burners was reduced to 3,000 kg of oil per hour. Shortly after charging the pig iron, the scrap had melted and a liquid slag had formed. A test sample taken at that time showed the following values:

$C = 2.8\%$
$P = 0.03$
$S = 0.04$

The temperature was approximately 1,300°C. The ensuing refining time lasted 70 minutes. During that time, the carbon content of the bath declined to 0.3%. The bath temperature was constantly controlled; it rose to 1,600°C. during that time. The temperature rise was controlled by changing the oil rate at the end burners in the range from zero to 3,000 kg an hour. The immersion lances were removed from the furnace upon reaching the final analysis. The steel was tapped at the following composition:

$C = 0.3\%$
$Mn = 0.2$
$P = 0.01$
$S = 0.02$

Hydrocarbons were used as protective media while the immersion lances were in operation, ordinarily in proportions less than 10% by weight with respect to the amounts of oxygen, preferably from 2 to 5% by weight. The protective medium rates were monitored by suitable measuring instruments and each immersion lance were individually regulated. The regulating rates were set as a function of tuyere burn-off. Ordinarily the tuyere wear was less than 5mm per charge, the refining time with oxygen on the average being 1 hour.

In a few applications, where larger burn-off might be tolerated, other gases may be used as protective media, these being gases which will not react with the steel bath. Thus, in some instances, carbon dioxide could be used. The rates involved then must be considerably increased, however all those measured will become superfluous, which relate to the cooling of the protective medium. Approximately 30% of $CO_2$ with respect to oxygen were found sufficient. However, tuyere wear increased approximately ten-fold, that is, to about 50 mm per charge (Assuming 1 hour of refining).

What is claimed is:

1. A process for refining a molten metal melt in a hearth furnace by means of oxygen which comprises:

providing a movable lance supported for movement relative to said hearth furnace and movement into and out of said melt, said lance including a refractory sheath within which there are two concentric pipes, one of said pipes being a centrally located pipe for supplying oxygen to refine said melt and the second of said pipes being disposed around the oxygen pipe and being connected to a source of fluid hydrocarbon for protecting said lance from burning off when immersed in said metal melt;

moving said lance into said melt;

simultaneously blowing oxygen into said melt through said central pipe and hydrocarbon fluid into said melt through the annular gap between said two pipes, the amount of hydrocarbon being not more than 10% by weight of the oxygen, thereby refining said metal melt; and after refining said melt to the extent desired, withdrawing said lance from said melt.

2. A process as defined in claim 1 wherein the discharge direction of the oxygen issuing from the immersion lance is essentially parallel to the metal melt surface.

3. A process as defined in claim 1 wherein the protective medium is a fluid selected from the group consisting of liquid hydrocarbons and gaseous hydrocarbons.

4. A process as defined in claim 3 wherein the gaseous hydrocarbons are selected from natural gas, coke oven gas, methane, ethane, propane, butane and mixtures thereof.

5. A process as defined by claim 3 wherein the liquid hydrocarbon is selected from light fuel oil, heavy fuel oil, oil, kerosene, hexane, pentane, heptane, octane or derivatives therefrom, individually, in mixtures and/or dispersed in other substances.

6. A process as defined by claim 1 wherein the melt is refined in part by gases issuing from the immersion lances dipped into the metal melt during one or more periods of the charging sequence time.

7. A process as defined by claim 1 wherein several immersion lances are used simultaneously in one refining vessel.

* * * * *